US005088736A

United States Patent [19]

Chuang

[11] Patent Number: 5,088,736

[45] Date of Patent: Feb. 18, 1992

[54] TOY PINBALL MACHINE

[76] Inventor: Chuan-Tien Chuang, No. 40, Lane 174, Ta Hsing Street, Tainan, Taiwan

[21] Appl. No.: 642,000

[22] Filed: Jan. 16, 1991

[51] Int. Cl.[5] ..... A63F 7/02

[52] U.S. Cl. ..... 273/121 R; 273/119 R; 273/120 R; 273/129 R; 273/129 W

[58] Field of Search ..... 273/108, 118, 119, 120, 273/121, 122, 124, 125, 127, 129

[56] References Cited

U.S. PATENT DOCUMENTS 4,203,603 5/1980 Konta ..... 273/121 R
4,223,889 9/1980 Konta ..... 273/121 A
4,244,575 1/1981 Hori ..... 273/121 R

FOREIGN PATENT DOCUMENTS 2064340 6/1981 United Kingdom ..... 273/121 R

*Primary Examiner*—Edward M. Coven
*Assistant Examiner*—Raleigh W. Chiu
*Attorney, Agent, or Firm*—Varndell Legal Group

[57] ABSTRACT

A miniaturized pinball machine serving as a funny toy is provided. The pinball machine includes a machine body, a ball-feeding device mounted between a ball-storing room and a ball path for feeding from the room to the path a ball to be propelled by a propelling medium through the path to an inclined board, a striking device striking the ball on the board to delay and/or prevent the ball from falling into the room, and a plurality of springing devices back springing on the board the ball bumping thereagainst.

5 Claims, 7 Drawing Sheets

TOY PINBALL MACHINE

BACKGROUND OF THE INVENTION

The present invention relates to a toy, and more particularly to a toy pinball machine.

The conventional pinball toy includes an inclined board, an optionally hidden ball path, a plurality of protrusions or pins on the board for lengthening the time during which the ball is downwardly falling on the board, and a propelling medium for propelling the ball through the ball path to the inclined board. Such a pinball toy, however, can only enthuse the player for a relatively short period.

SUMMARY OF THE INVENTION

It is therefore an object of the present invention to provide a miniaturized pinball machine to diversify the pinball toy.

According to the present invention, the toy pinball machine includes a machine body having an inclined board, a ball-feeding device mounted between a ball-storing room and a ball path for feeding from the room to the path, a ball to be propelled by a propelling medium through the path to the board, a striking device capable of striking the ball on the board to delay and/or prevent the ball from falling into the room, and a plurality of springing devices disposed on the board and capable of back springing the ball bumping thereagainst.

Certainly, a sounding effect can be produced each time when the striking device strikes the ball or the springing device back springs the ball.

Certainly, a counter can be incorporated to count each time when any springing device back springs the ball.

The present invention may best be understood through the following description with reference to the accompanying drawings, in which:

DETAILED DESCRIPTION OF THE PREFERRED EMBODIMENT

Figure 1:
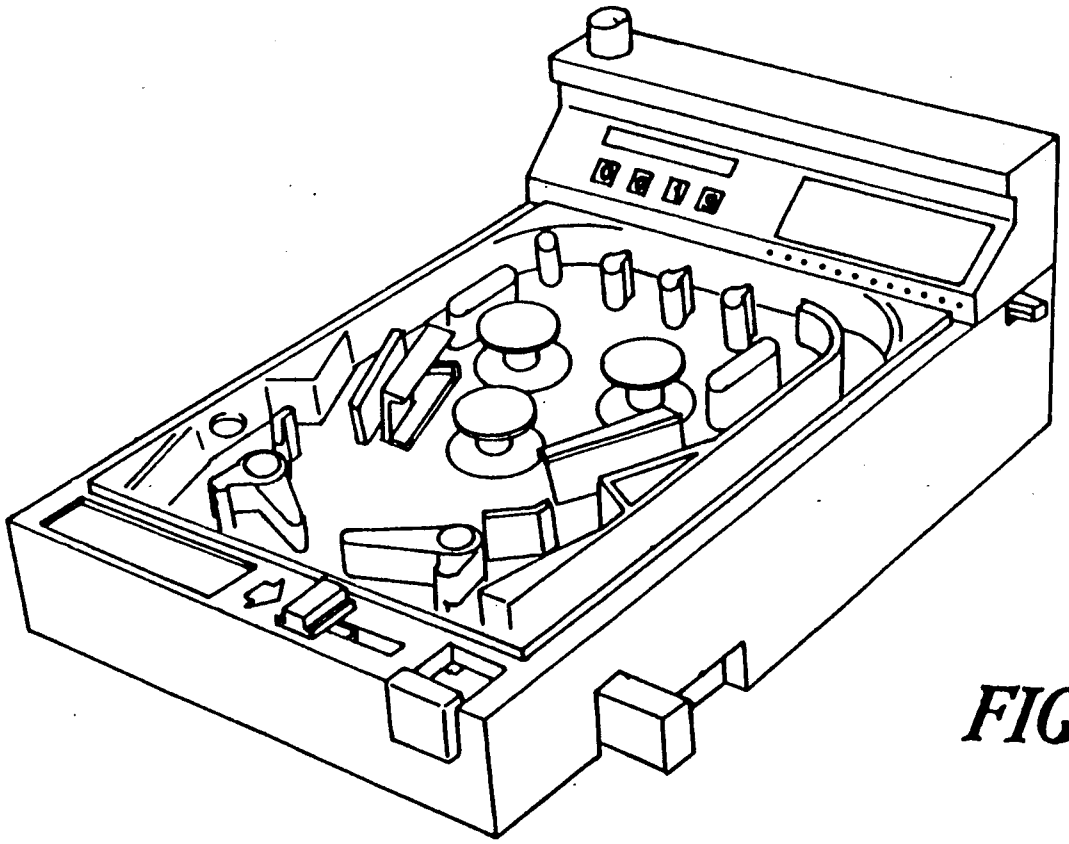
FIG. 1 is a perspective view showing a preferred embodiment of a toy pinball machine according to the present invention.
Figure 2:
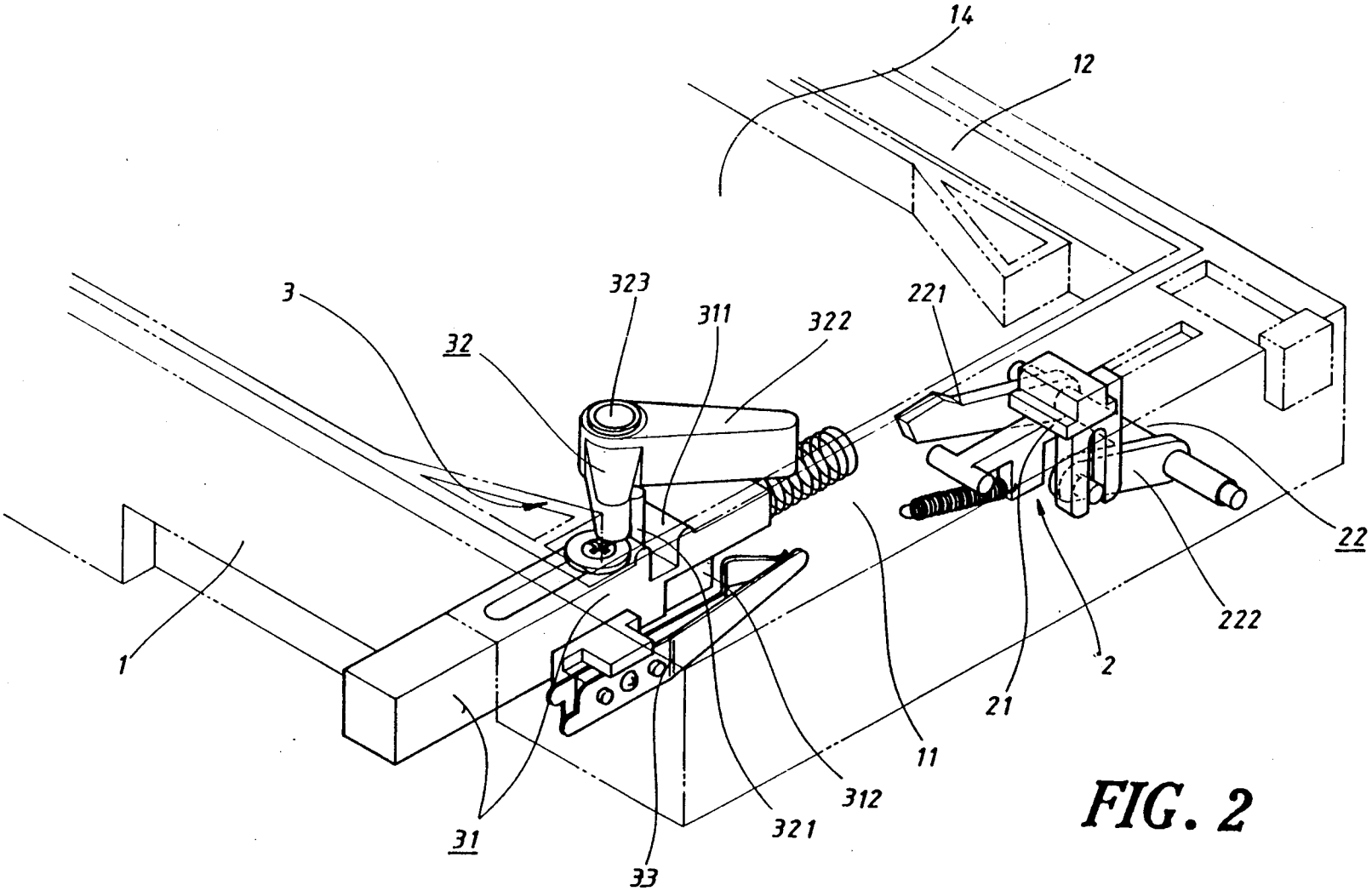
FIG. 2 is a schematically structural view showing a ball-feeding device, a propelling medium and a striking device of a toy pinball machine in FIG. 1.
Figure 3:
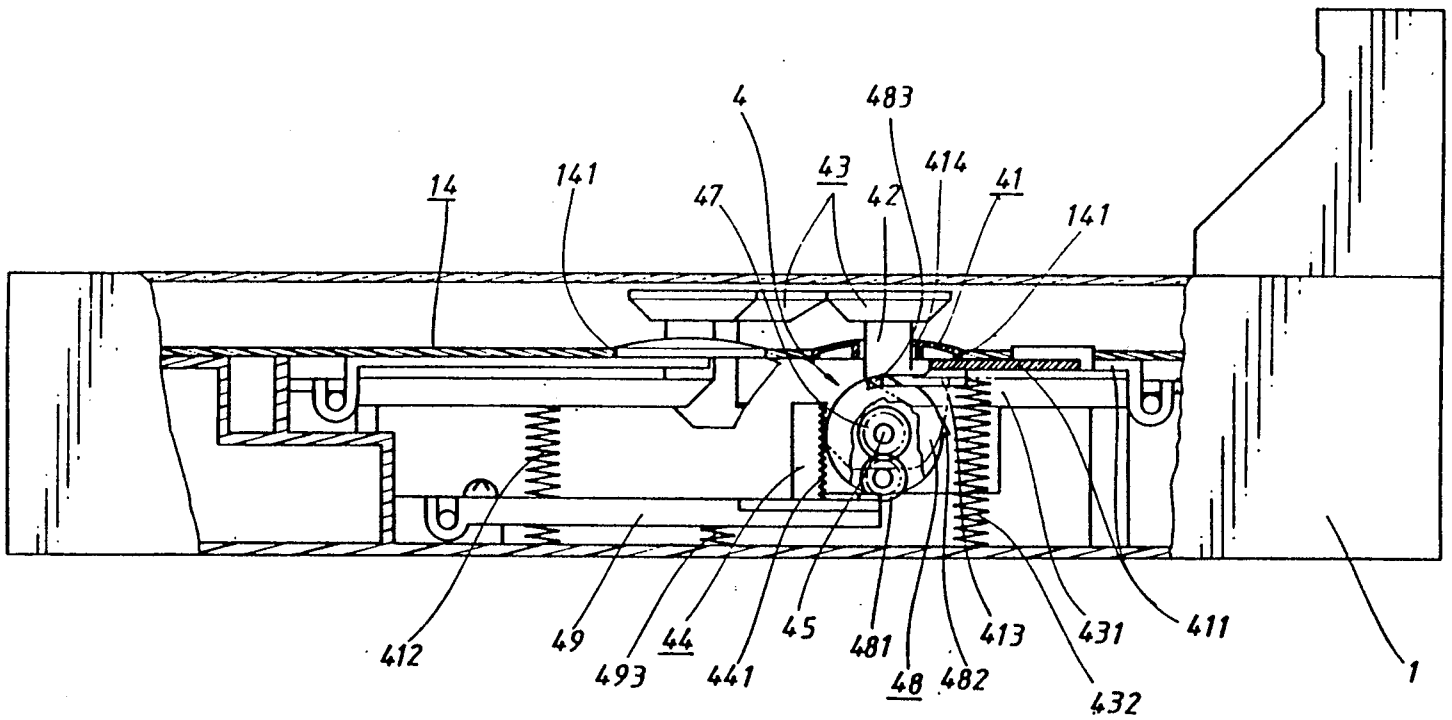
FIG. 3 is a schematically structural view showing a springing device and a rotating shaft of a toy pinball machine in FIG. 1.
Figure 4:
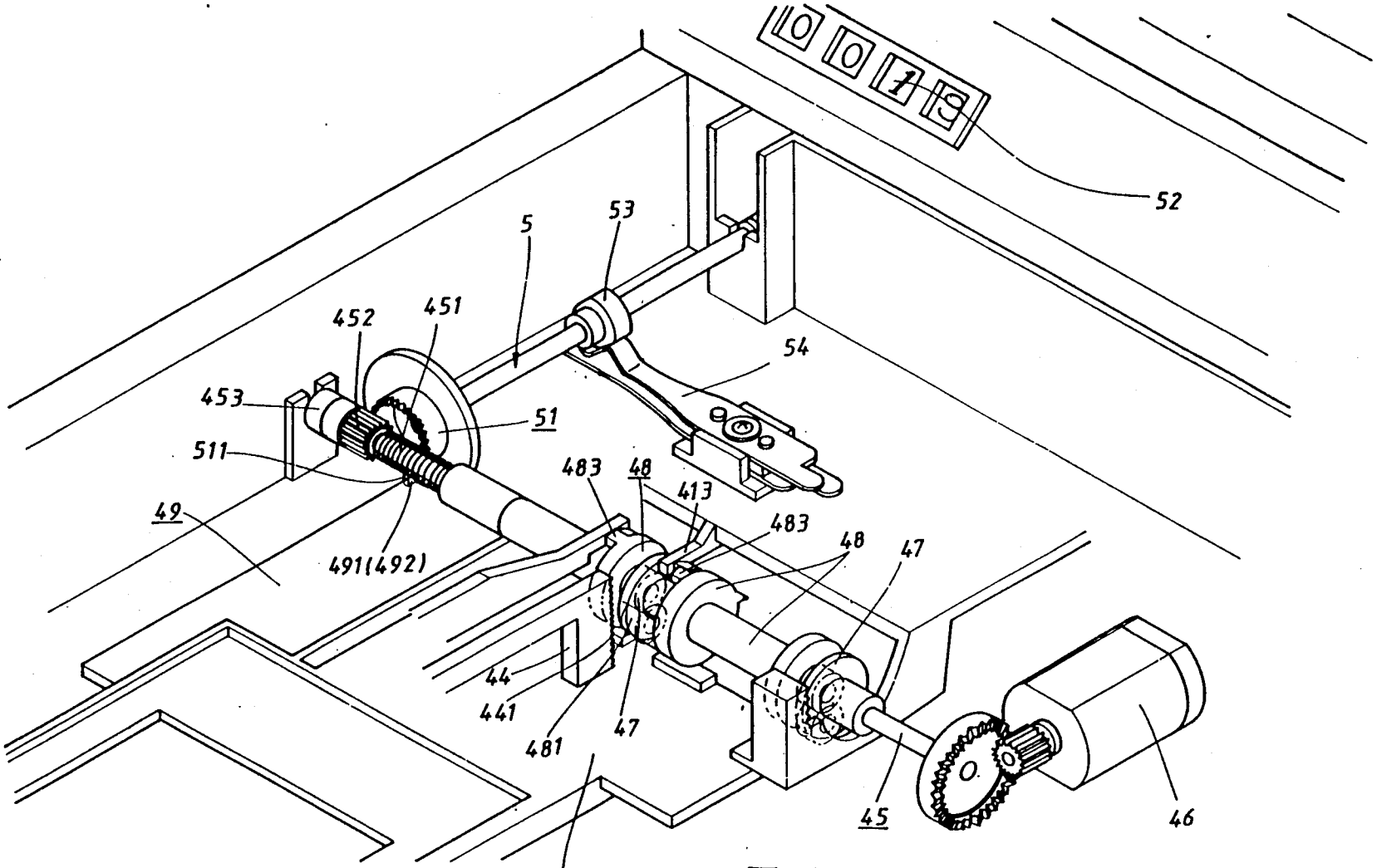
FIG. 4 is a schematically structural view showing a rotating shaft and a transmitting shaft for a counter of a toy in FIG. 1.
Figure 5:
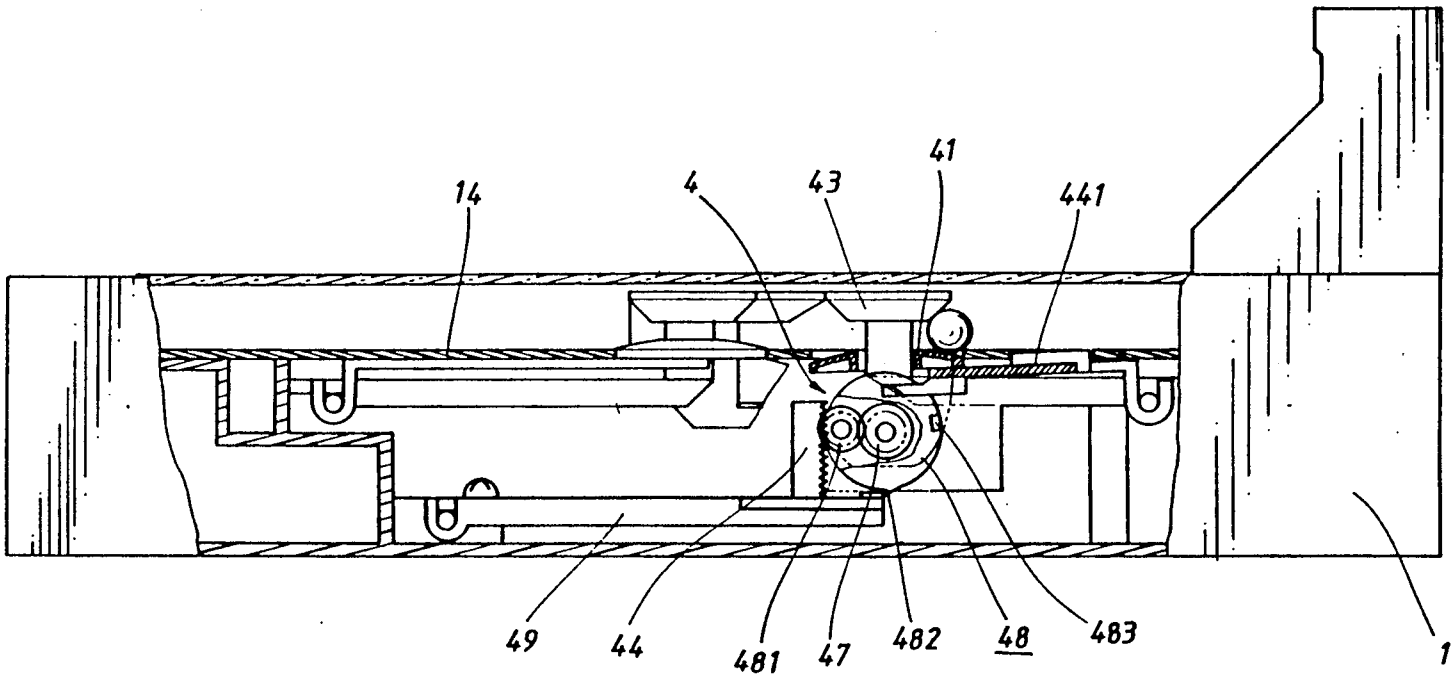
FIG. 5 being similar to FIG. 3 shows that a ball bumps against a springing device of a toy pinball machine in FIG. 1.

Referring now to FIGS. 1–5, a toy pinball machine according to the present invention includes a machine body 1 having a ball-storing room 11, a ball path 12, a propelling medium 13 and an inclined board 14 having a plurality of holes 141, a ball feeding device 2 mounted between room 11 and path 12 for feeding from room 11 to path 12 a ball to be propelled by medium 13 through path 12 to board 14, a striking device 3 capable of striking the ball on board 14 to delay and/or prevent the ball from falling into room 11, and a plurality of springing devices 4 capable of back springing the ball bumping thereagainst.

Ball-feeding device 2 includes an actuating piece 21 and a crank shaft 22 having a ball-feeding handle 221 mounted between room 11 and path 12 and a connector 222 slidably connected to actuating piece 21 in the manner that when piece 21 is translated, handle 221 will feed the ball from room 11 to path 12. Striking device 3 includes a spring-biased button 31 slidably mounted on body 1 and having a transverse groove 311, a striking medium 32 pivotally mounted on a shaft 323 secured to body 1 and having an extension 321 slidably guided in groove 311 and a striking piece 322 capable of striking the ball when button 31 is inwardly slid, and a sounder 33 electrically connecting thereto a contact switch mechanically responsive to a groove 312 on button 31 so that sounder 33 will sound when button 31 is pushed.

Each springing device 4 includes a floating plate 41 protruding through one of holes 141 and having a central hole 414 and an extending plate 411 having a pawl 413 and urged by a spring 412 against board 14, an actuating shaft 42 passing through central hole 414 and having a top extension 43 capable of cooperating with floating plate 41 to match therebetween and spring thereby the ball, an extending plate 431 upwardly biased by a spring 432 and a braking extension 44 having a rack surface 441, a rotating shaft 45 driven by a motor 46, unrotatably fixing thereto a plurality of braking gears 47 and sleeving thereon a pleurality of braking disks 48 respectively made adjacent gears 47, and a pawling plate 49 which is positioned under shaft 45, upwardly urged by a spring 493 and downwardly urged by braking extension 44 and has a first protuberance 491 and a second protuberance 492. Each braking disk 48 includes a planet gear 481 meshing with a corresponding braking gear 47, a peripheral protuberance 482 capable of engaging with first protuberance 491 of the lower pawling plate 49 and a side protuberance 483 capable of engaging with pawl 413 of the upper extending plate 411 in which protuberances 482, 483 have a phasically angular difference of 90°. When protuberances 482, 491 interengage, planet gear 481 will also mesh with rack surface 441 so that braking gear 47 will indirectly downwardly move braking extension 44 to finally disengage protuberances 482, 491 from each other. A compression spring 451 is sleeved on rotating shaft 45 for biassingly contacting braking gears and disks 47, 48 together to synchronously rotate braking disks 48 with shaft 45 if protuberances 482 and 491 or protuberances 483 and pawl 413 are not interengaged. Rotating shaft 45 additionally mounts thereon a transmitting gear 452 and an end sleeve 453.

A transmitting shaft 5 has a first end coupled to a counter 52 and a second end mounting thereon a surface gear 51 meshing with transmitting gear 452 and having a protrusion 511 engageable with second protuberance 492 of the lower pawling plate 49, and intermediately sleeves thereto a cam 53 capable of contacting with a contact switch 54 electrically connected to a sounding device.

The operation of the present toy pinball machine is as follows: First, the ball is fed by device 2 to path 12 to be propelled by medium 13 to board 14. When the ball bumps against a springing device 4, floating plate 41 is caused by the weight of the ball to downwardly move to thus disengage protuberance 483 from pawl 413 to allow the corresponding braking disk 48 to be synchronously rotated by shaft 45 until protuberances 482, 491 interengage. Since planet gear 481 also meshes with rack surface 441 now, rotating shaft 45 will act through gears 47, 481 to downwardly move braking extension 44 to thus finally disengage protuberances 482, 491 from each other to enable braking disk 48 to be synchronously rotated by shaft 45 again. While braking extension 44 is downwardly moved, top extension 43 is equally downwardly moved to thus decrease the distance between extension 43 and plate 41 to thus back spring the ball which allows plate 41 to return in position to disengage braking extension 44 and planet gear 48 from and interengage protuberance 483 and pawl 413 with each other. When pawling plate 49 is downwardly urged by braking extension 44, protuberance 492 will disengage from protrusion 511 which allows gear 452 to rotate transmitting shaft 5 to enable counter 52 to count and to contact the contact switch 54 electrically connected to the sounding device.

Figure 6:
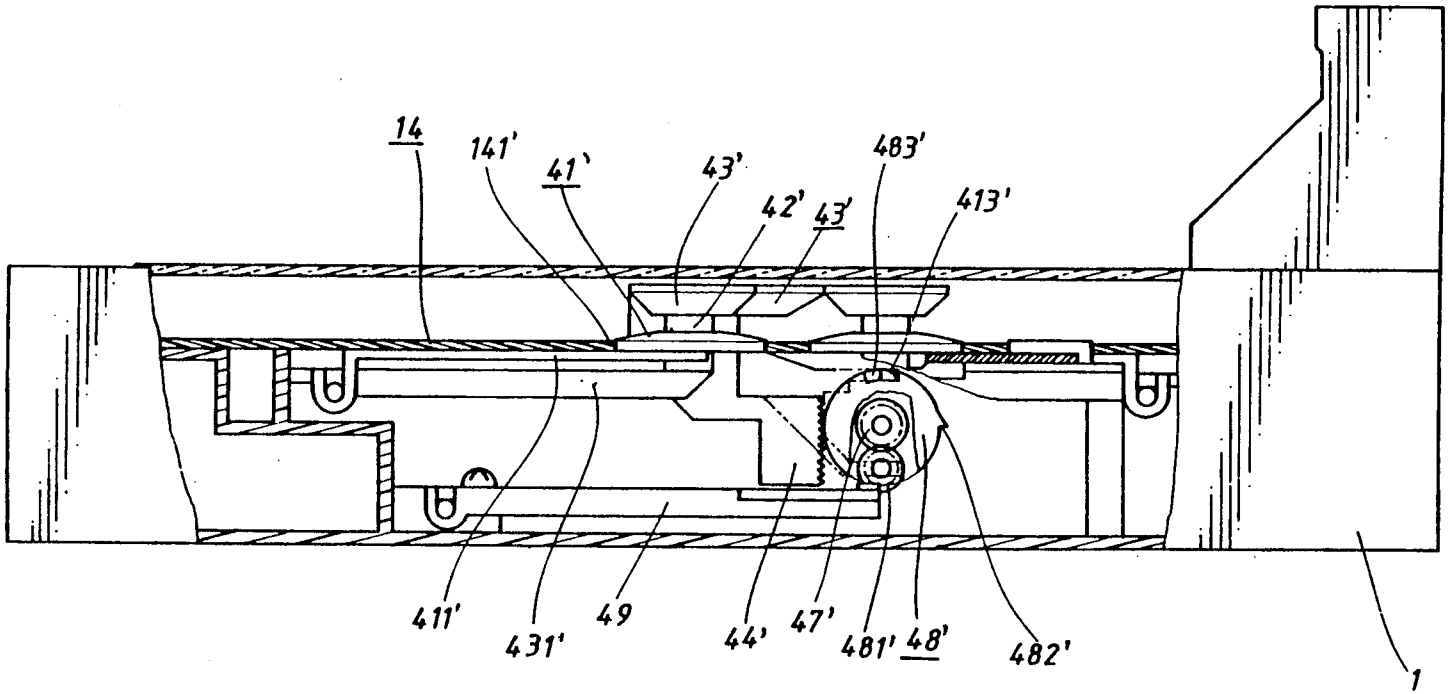
FIG. 6 is a structurally schematical view showing a second preferred embodiment of a springing device of a toy pinball machine according to the present invention.
Figure 7:
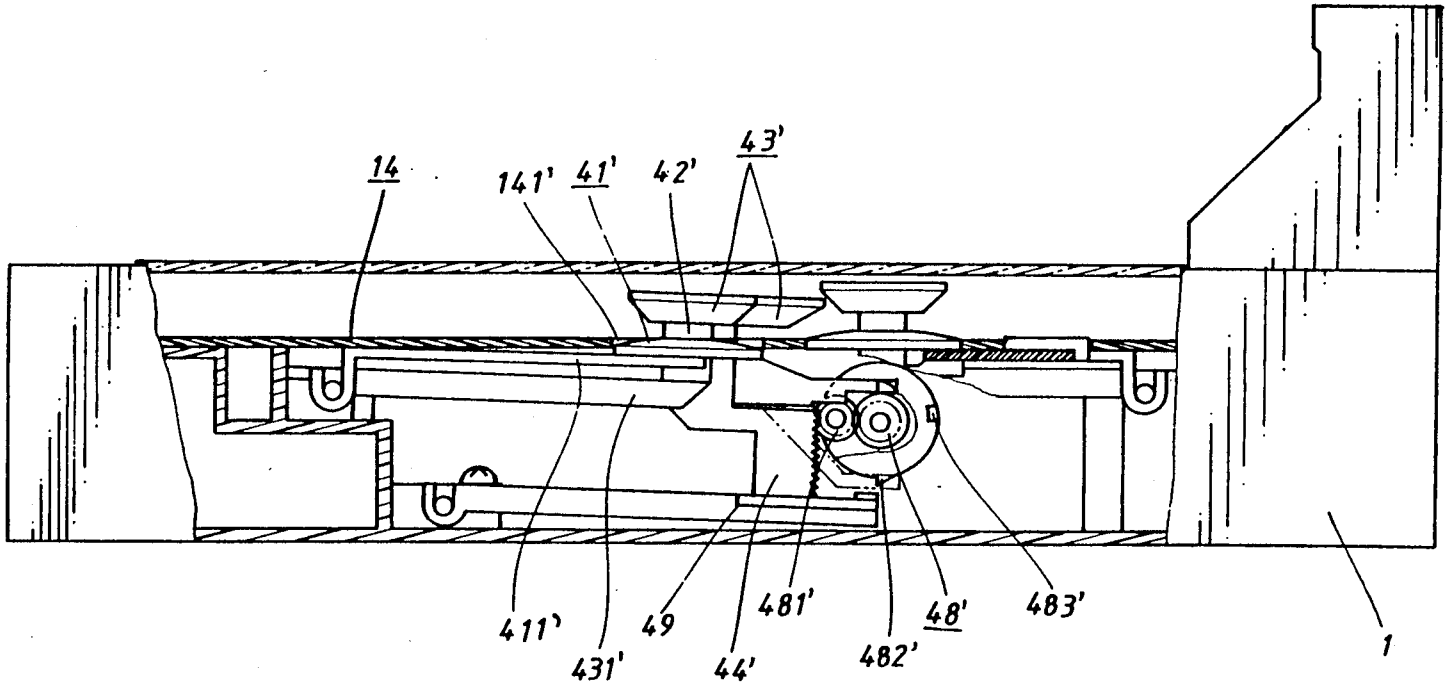
FIG. 7 is a schematical view showing how a springing device in FIG. 6 operates.

FIGS. 6 and 7 show a structurally different springing device to be used in the present toy pinball machine. Since it operates in a manner substantially the same with the above described springing device 4, no further detail relating thereto will be described in the following.

It should be understood that the above described embodiments are only illustrative but not limitative for the present invention capable of covering modifications and changes made to the described embodiments in its spirit and scope defined in the appended claims.

I claim:

1. A toy pinball machine comprising:

a machine body having an inclined board, a ball-storing room, a ball path, and a propelling medium;

a ball feeding device mounted between said room and said path for feeding from said room to said path a ball to be propelled by said medium through said path to said board;

a striking device mounted on said body and capable of striking said ball on said board to delay and/or prevent said ball from falling into said room; and a plurality of springing devices disposed on said board and capable of back springing said ball bumping thereagainst, said ball feeding device including:

an actuating piece mounted on said body; and a crank shaft having a ball-feeding handle mounted between said room and said path, and a connector slidably connected to said actuating piece in a manner that when said actuating piece is translated, said ball-feeding handle will feed said ball from said room into said path.

2. A toy pinball machine comprising:

a machine body having an inclined board, a ball-storing room, a ball path, and a propelling medium;

a ball feeding device mounted between said room and said path for feeding from said room to said path a ball to be propelled by said medium through said path to said board;

a striking device mounted on said body and capable of striking said ball on said board to delay and/or prevent said ball from falling into said room; and a plurality of springing devices disposed on said board and capable of back springing said ball bumping thereagainst, said board having a plurality of holes beyond which said springing devices respectively protrude, each of said springing devices including:

a floating plate protruding through one of said holes, upwardly biased by a spring, and including a central hole, a first extending plate urged by said spring against said board and having a pawl thereon:

an actuating shaft passing through said central hold, and including a top extension capable of cooperating with said floating plate to match therebetween and spring thereby said ball, a second extending plate upwardly biassed by a spring, and a braking extension having a rack surface:

a rotating shaft mounted on said body and having fixed thereto a braking gear, said shaft sleeving thereon a braking disk which includes a first protuberance engageable with said pawl in a manner that when they interengage, said braking disk cannot rotate with said rotating shaft, a planet gear meshing with said braking gear, said braking disc including a second protuberance; and a pawling plate mounted in said body and capable of engaging with said second protuberance in a manner that when they interengage, said planet gear will mesh with said rack surface.

3. A toy pinball machine according to claim 2 wherein said first protuberance is peripherally provided on said braking disk, said second protuberance is provided on one side of said braking disk, and said protuberances have a phasically angular difference of 90°.

4. A toy pinball machine according to claim 2, further comprising:

a compression spring sleeved on said rotating shaft for urging said braking disk toward said braking gear;

a transmitting gear mounted on said rotating shaft; and a transmitting shaft having a first end coupled to a counter and a second end mounting thereon a surface gear which meshes with said transmitting gear and has a protrusion capable of engaging with said pawling plate.

5. A toy pinball machine according to claim 4 wherein said transmitting shaft intermediately sleeves thereto a cam capable of contacting with a contact switch electrically connected to a sounding device.

* * * * *